US010030456B2

(12) United States Patent
Miller et al.

(10) Patent No.: US 10,030,456 B2
(45) Date of Patent: Jul. 24, 2018

(54) METHOD AND SYSTEM FOR EXTENDING REACH IN DEVIATED WELLBORES USING SELECTED VIBRATION FREQUENCY

(71) Applicants: SCHLUMBERGER TECHNOLOGY CORPORATION, Sugar Land, TX (US); MASSACHUSETTS INSTITUTE OF TECHNOLOGY, Cambridge, MA (US)

(72) Inventors: James Miller, Boston, MA (US); Nathan Wicks, Somerville, MA (US); Jahir A. Pabon, Newton, MA (US); Pedro Reis, Cambridge, MA (US)

(73) Assignee: SCHLUMBERGER TECHNOLOGY CORPORATION, Cambridge, MA (US)

( * ) Notice: Subject to any disclaimer, the term of this patent is extended or adjusted under 35 U.S.C. 154(b) by 337 days.

(21) Appl. No.: 14/567,538

(22) Filed: Dec. 11, 2014

(65) Prior Publication Data

US 2015/0159452 A1 Jun. 11, 2015

Related U.S. Application Data

(60) Provisional application No. 61/914,469, filed on Dec. 11, 2013.

(51) Int. Cl.

| | |
|---|---|
| ***E21B 31/00*** | (2006.01) |
| ***E21B 7/24*** | (2006.01) |
| ***E21B 28/00*** | (2006.01) |
| ***E21B 19/22*** | (2006.01) |
| ***E21B 41/00*** | (2006.01) |

(52) U.S. Cl.

CPC ..... *E21B 19/22* (2013.01); *E21B 7/24* (2013.01); *E21B 28/00* (2013.01); *E21B 31/005* (2013.01); *E21B 41/00* (2013.01)

(58) Field of Classification Search

CPC ..... E21B 31/005; E21B 19/22; E21B 28/00; E21B 41/00; E21B 17/20; E21B 7/024; E21B 7/20; G05D 19/02

See application file for complete search history.

(56) References Cited

U.S. PATENT DOCUMENTS 6,439,318 B1 8/2002 Eddison et al.
6,907,927 B2 6/2005 Zheng et al.

(Continued)

FOREIGN PATENT DOCUMENTS

WO 2012161595 A1 11/2012

OTHER PUBLICATIONS

IADC-SAE 59235—Lateral Drillstring Vibrations in Extended-Reach Wells—Heisig et al. (Feb. 23-25, 2000.*

Castaneda et al., "Coiled Tubing Milling Operations: Successful Application of an Innovative Variable-Water Hammer Extended-Reach BHA to Improve End Load Efficiencies of a PDM in Horizontal Wells", 2011, 143346—MS SPE Conference Paper, 19 pages.

(Continued)

*Primary Examiner* — George S Gray

(57) ABSTRACT

A method for extending reach of a coiled tubing string in a deviated wellbore includes determining a frequency of vibration of the tubing string based on a function of the bending resonance of the tubing string and vibrating the tubing string at the determined frequency while the tubing string is inside the wellbore. Embodiments may also include a non-transitory computer-readable storage medium to execute the foregoing method and a system for extending reach of a coiled tubing string in a deviated wellbore.

19 Claims, 5 Drawing Sheets

(56) References Cited

U.S. PATENT DOCUMENTS

| | | | | |
|---|---|---|---|---|
| 7,757,783 | B2 | 7/2010 | Pfahlert | |
| 2004/0055744 | A1* | 3/2004 | Zheng | E21B 4/18 166/249 |
| 2006/0065440 | A1* | 3/2006 | Hutchinson | E21B 47/04 175/40 |
| 2011/0203395 | A1 | 8/2011 | Pfahlert | |
| 2013/0049981 | A1 | 2/2013 | MacPherson et al. | |
| 2013/0186619 | A1 | 7/2013 | Wicks et al. | |
| 2013/0186686 | A1* | 7/2013 | Heisig | E21B 7/24 175/40 |
| 2013/0246029 | A1 | 9/2013 | Wicks et al. | |
| 2014/0196952 | A1 | 7/2014 | Schicker et al. | |
| 2015/0193126 | A1* | 7/2015 | Whalley | E21B 44/00 715/733 |

OTHER PUBLICATIONS

Sola, et al., "New Downhole Tool for Coiled Tubing Extended Reach", 60701—MS SPE Conference Paper, 2000, 8 pages.

Robertson, et al., "Dynamic Excitation Tool: Developmental Testing and CTD Field Case Histories", 2004, SPE/ICoTA Coiled Tubing Conference and Exhibition, Mar. 23-24, SPE 89519, 16 pages.

Wicks, Nathan, et al., "Horizontal Cylinder-in-Cylinder Buckling Under Compression and Torsion: Review and Application to Composite Drill Pipe," International Journal of Mechanical Sciences 50 (2008) pp. 538-549.

Office Action for related U.S. Appl. No. 14/567,589, dated Mar. 21, 2017, 17 pages.

* cited by examiner

METHOD AND SYSTEM FOR EXTENDING REACH IN DEVIATED WELLBORES USING SELECTED VIBRATION FREQUENCY

CROSS-REFERENCE TO RELATED APPLICATIONS

The present application claims priority under 35 U.S.C. § 119(e) to Provisional Application Ser. No. 61/914,469 , filed on Dec. 11, 2013 and entitled "METHOD FOR EXTENDING REACH IN DEVIATED WELLBORES," which is hereby incorporated by reference herein in its entirety.

TECHNICAL FIELD

The subject disclosure relates to the hydrocarbon industry. More particularly, the subject disclosure relates to a method for extending reach in deviated wellbores.

BACKGROUND

Coiled tubing refers to metal piping, used for interventions in oil and gas wells and sometimes as production tubing in depleted gas wells. Coiled tubing operations typically involve at least three primary components. The coiled tubing itself is spooled on a large reel and is dispensed onto and off of the reel during an operation. The tubing extends from the reel to an injector. The injector moves the tubing into and out of the wellbore. Between the injector and the reel is a tubing guide or gooseneck. The gooseneck is typically attached or affixed to the injector and guides and supports the coiled tubing from the reel into the injector. Typically, the tubing guide is attached to the injector at the point where the tubing enters. As the tubing wraps and unwraps on the reel, it moves from one side of the reel to the other (side-to-side).

Residual bending is one of the technical challenges for coiled tubing operations. Residual bend exists in every coiled tubing string. During storage and transportation, a coiled-tubing string is plastically deformed (bent) as it is spooled on a reel. During operations, the tubing is unspooled (bent) from the reel and bent on the gooseneck before entering into the injector and the wellbore. Although the reel is manufactured in a diameter as large as possible to decrease the residual bending incurred on the coiled tubing, the maximum diameter of many reels is limited to several meters due to storage and transportation restrictions.

As the coiled tubing goes through the injector head, it passes through a straightener; but the tubing retains some residual bending strain. That strain can cause the coiled tubing to wind axially along the wall of the wellbore like a long, stretched spring. In conventional coiled tubing operations, the tubing is translated along the borehole either via gravity or via an injector pushing from the surface. As a result, the end of the coiled tubing being translated into the borehole is load-free. For an extended reach horizontal wellbore, an axial compressive load will build up along the length of the coiled tubing due to frictional interactions between the coiled tubing and the borehole wall. As the borehole "doglegs" away from the vertical direction, the axial load changes in a tensile direction. A typical axial load as a function of measured depth in a wellbore is plotted in FIG. 1 where the wellbore has a 4000 foot vertical section; a 600 foot, 15 degree per 100 foot dogleg section from vertical to horizontal; and a horizontal section that extends to the end of the wellbore.

When a long length of coiled tubing is deployed in the horizontal portion of the well bore, frictional forces are exerted on the tubing string from the wellbore wall rubbing on the coiled tubing, increasing the axial compressive load. If the horizontal section of the wellbore is sufficiently long, the axial compressive load will be large enough to cause the coiled tubing to buckle. A first buckling mode of the tubing string is referred to as "sinusoidal buckling". In the first buckling mode, the coiled tubing snakes along the bottom of the borehole with curvature in alternating senses. This is a fairly benign buckling mode, in the sense that neither the internal stresses nor frictional loads increase significantly.

A second buckling mode is termed "helical buckling". The helical buckling mode is characterized by the coiled tubing spiraling or wrapping along the borehole wall. Helical buckling can have quite severe consequences. For example, once the coiled tubing begins to buckle helically, the normal force exerted by the borehole wall on the coiled tubing string increases very quickly. This causes a proportional increase in frictional loading, which consequently creates an increase in axial compressive load in the tubing string between the injector and the end of the helically buckled region. Once helical buckling has been initiated, further injection of the tubing causes that axial compressive load to increase sharply with injection to a level that indicates that the tubing string is in a condition termed "lock-up". A plot of axial load as a function of measured depth for a coiled tubing, which is almost in a locked up state is shown in FIG. 2. Such lock-up limits the use of coiled tubing as a conveyance member for logging tools in highly-deviated, horizontal, or up-hill sections of wellbores.

Various methods are available to avoid lock-up and extend the reach of coiled tubing. Some of these methods include tractors, tapered coiled tubing strings, alternate materials e.g. composite coiled tubing, straighteners, friction reducers, and injecting a light fluid inside the coiled tubing. These methods are aimed at delaying the onset of helical buckling, which, as described above, may lead to lock-up of the coiled tubing string.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

One strategy to delay or avoid lock-up of coiled tubing (hereinafter referred to as "tubing string") that is being introduced into a wellbore is to induce vibration in the tubing string. Several different types of induced vibration are possible, which can be used separately or in combination with each other. These types include:

1) Axial vibration—vibration is induced along the axis of the coiled tubing/wellbore;
2) Lateral vibration—vibration is induced orthogonal to the axis of the coiled tubing/wellbore;
3) Torsional—rotational vibration is induced about the axis of the coiled tubing/wellbore; and
4) Lateral rotational—rotational vibration is induced about an axis orthogonal to the axis of the coiled tubing/wellbore.

Vibration of a tubing string can be induced by vibration sources (e.g., apparatuses) that may be located in one or several locations along the length of the tubing string. For example, one location for a vibration source may be at the surface (e.g., at the injector head). Also, for example, a vibration source may be located at or near the free end of the tubing string (e.g., at an element of the bottom hole assembly, such as a tractor, etc.). Additionally, for example, one or more vibration sources may be distributed along the length of the tubing string between its free end in the wellbore and its constrained end at the injector at the surface. The latter example may be accomplished by assembling one or more vibration sources to the coiled tubing during its manufacture or assembling one or more vibration sources onto discrete lengths of the coiled tubing such as at joints of such sections (i.e., connectors joining the discrete lengths may house the vibration sources).

According to one aspect, a method is provided for extending reach of a coiled tubing string in a deviated wellbore. The method includes determining a frequency of vibration of the tubing string based on a function of the bending resonance of the tubing string. Bending resonance of a tubing string occurs when the tubing string is constrained in a certain manner and vibrates at a natural frequency. The method also includes vibrating the tubing string at the determined frequency while the tubing string is inside the wellbore.

In one embodiment the bending resonance of the tubing string is determined, at least partially, by the radial clearance between the tubing string and the wellbore.

In one embodiment bending resonance of the tubing string is determined, at least partially, by a constant relating to boundary conditions of the tubing string. In one embodiment the constant may be a value between $\pi$ and 1.5 $\pi$. The method may further include selecting the constant based on modeled boundary conditions.

According to another aspect, a non-transitory computer-readable storage medium is provided that stores an executable computer program for causing a computer to execute the aforementioned method of extending reach of a coiled tubing string in a deviated wellbore.

According to yet another aspect, a system for extending reach of a coiled tubing string in a deviated wellbore is provided. The system includes a controller constructed to determine a vibration frequency for vibrating the tubing string based on a function of the bending resonance of the tubing string and output a vibration frequency control signal based on the determined vibration frequency. Also, the system includes a vibration source constructed to vibrate the tubing string at the determined frequency based at least on the control signal output from the controller.

Additional aspects, embodiments, objects and advantages of the disclosed methods may be understood with reference to the following detailed description taken in conjunction with the provided drawings.

DETAILED DESCRIPTION

The particulars shown herein are by way of example and for purposes of illustrative discussion of the examples of the subject disclosure only and are presented in the cause of providing what is believed to be the most useful and readily understood description of the principles and conceptual aspects of the subject disclosure. In this regard, no attempt is made to show details in more detail than is necessary, the description taken with the drawings making apparent to those skilled in the art how the several forms of the subject disclosure may be embodied in practice. Furthermore, like reference numbers and designations in the various drawings indicate like elements.

Helical buckling can limit the extent of reach in extended reach coiled tubing operations. One strategy to increase the reach of a tubing string in a deviated wellbore is to vibrate the tubing string. More particularly, the induced frequency of vibration of the tubing string may be matched to a resonant frequency of the tubing string in a bending mode, with the length scale of that bending mode defined by the wavelength of sinusoidal buckling of the tubing string. Such vibration of the tubing string at the resonant frequency may maximize the effectiveness of the vibration in extending reach of the tubing string.

Figure 1:
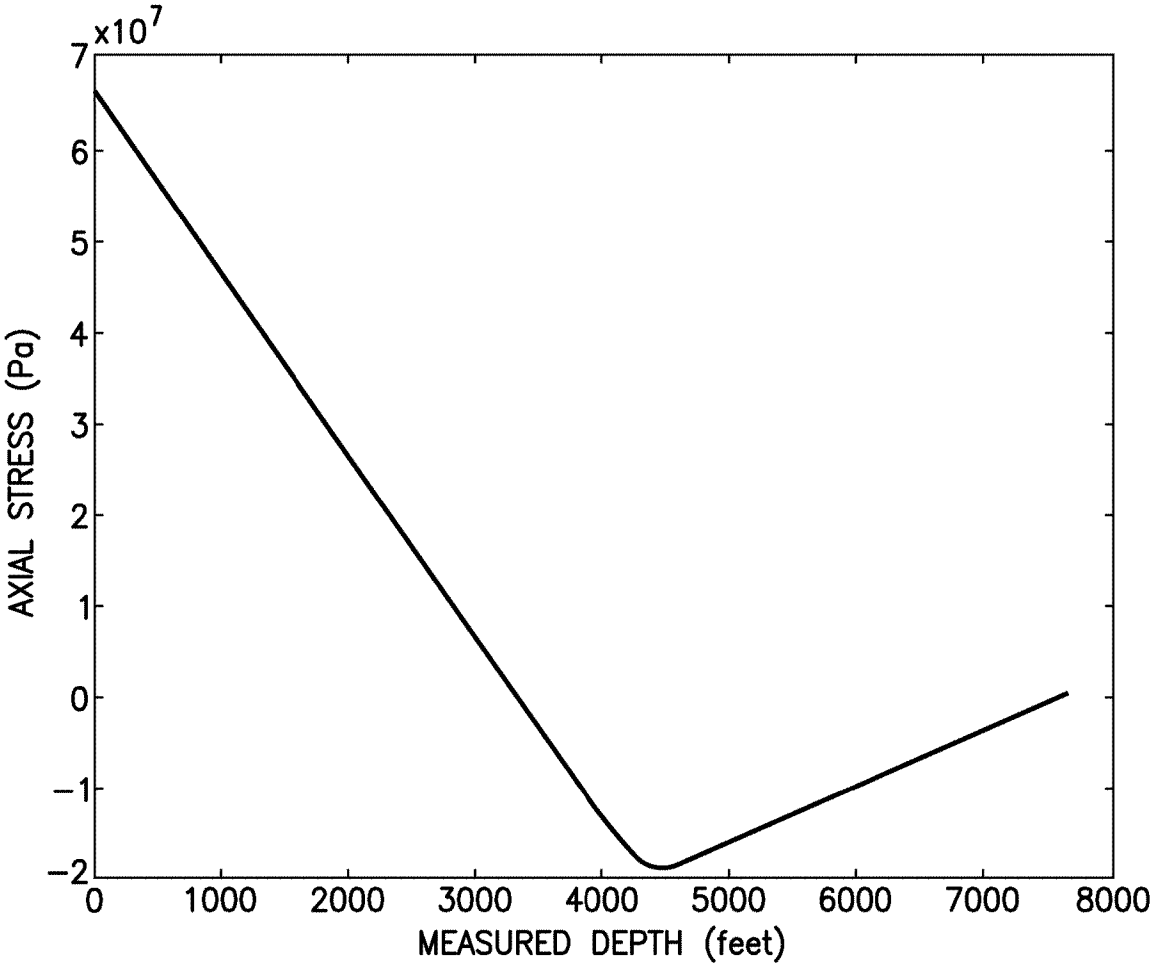
FIG. 1 shows a plot of axial load as a function of measured depth for a tubing string introduced into a cylindrical constraint.
Figure 2:
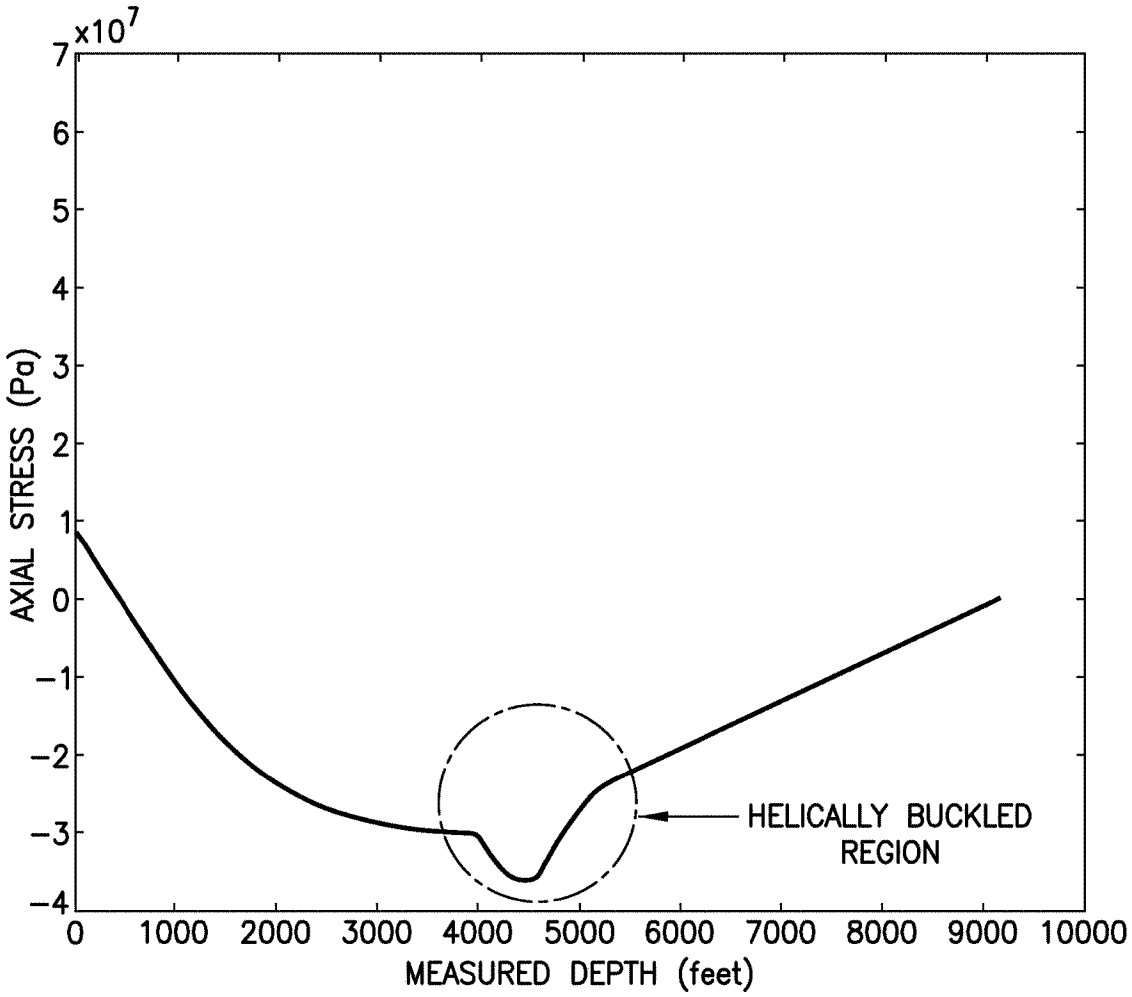
FIG. 2 shows a plot of axial load as a function of measured depth for a coiled tubing string that is almost in a locked up condition.

Helix initiation length is defined as the length of tubing between its free end and the position on the tubing where helical buckling is initiated. For example, the data shown in FIG. 2 relates to a tubing string that is almost in a locked up state, and shows that the ultimate depth near lockup is about 9000 ft and the measured depth at the start of helical buckling is about 4500 ft, resulting in an approximate helix initiation length of about 4500 ft.

Normalized helix initiation is equal to the helix initiation length when the tubing string is vibrated divided by the helix initiation length of the tubing string without being vibrated. Thus, a normalized helix initiation that is greater than 1 indicates that the vibration of the tubing string results in reach extension of the tubing string (i.e., a longer ultimate length at lock-up) beyond what would be possible without vibration of the tubing string. Thus, the larger the normalized helix initiation, the greater the benefit of the vibration. With the foregoing in mind, it is possible to determine a vibration frequency that will maximize the normalized helix initiation and, therefore, the reach extension of a tubing string.

Because lock-up occurs quickly after the onset of the helical buckling mode, it is possible to use helix initiation length as a proxy for determining the length of the tubing string at which lock-up will occur (lock-up length). Therefore, because helical initiation length and lock-up length are very highly correlated, the lock-up length can be approximated based on the helical initiation length. Consequently, if the onset of helical buckling can be delayed, lock-up can also be delayed.

Figure 3:
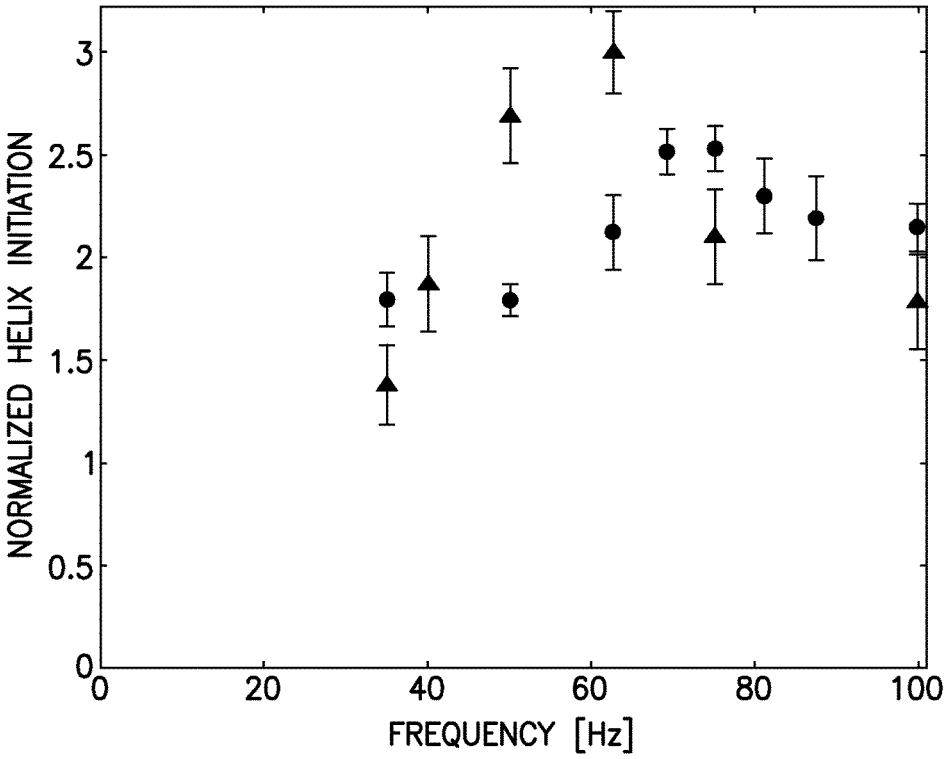
FIG. 3 shows a plot of normalized helix initiation as a function of vibration frequency for an experiment conducted with a tubing string within respective cylindrical constraints of differing inner diameter.

FIG. 3 shows a plot of normalized helix initiation as a function of vibration frequency of a rod that was tested during an experiment that was conducted to simulate the introduction of coiled tubing in a horizontal section of a deviated wellbore. In the experiment, a rubber rod was introduced respectively into two different cylindrical constraints (i.e., two plastic pipes that both have larger inner diameters than the outer diameter of the rod) in the presence of lateral vibration of the cylindrical constraints. The rod and cylindrical constraints were arranged to simulate relative movement of tubing string and the cylindrical constraint in the horizontal portion of the deviated wellbore. Due to the relative ease of doing so for the experimental setup, relative vibratory motion was induced by vibrating the pipe instead of the rod inside the pipe. However, it will be appreciated that the rod could be vibrated instead of the pipe to induce relative vibratory motion between the rod and the pipe. The data plotted with circles represents an experiment conducted using a rod having an outer diameter of 3.16 mm introduced into a pipe having an inner diameter of 12 mm. The data plotted with triangles represents an experiment conducted using the same rod having an outer diameter of 3.16 mm introduced into a larger pipe having an inner diameter of 21.7 mm.

For the case of the larger inner diameter pipe, the frequency corresponding to the largest normalized helical initiation is 75 Hz, indicating that when the pipe is vibrated at 75 Hz the effect of vibration on reach extension of the rod is maximized. Thus, the frequency of 75 Hz can be considered an optimum frequency at which to vibrate the rod in the larger inner diameter pipe. Similarly, for the smaller inner diameter pipe, the frequency corresponding to the largest normalized helical initiation is 60 Hz, indicating that when the pipe is vibrated at 60 Hz the effect of vibration on reach extension of the rod is maximized. Thus, the frequency of 60 Hz can be considered an optimum frequency at which to vibrate the rod in the smaller inner diameter pipe.

The aforementioned experiment resulted in a number of observations regarding reach extension of coiled tubing in deviated wellbores. During the experiment the detailed deformation occurring in the rod was visually observed and indicated that the maximum (optimum) frequencies of vibration shown in FIG. 3 are frequencies that excite a bending vibration mode in a sinusoidally buckled portion of the rod being inserted. The length of the bending modes was determined to be comparable to the wavelength of the sinusoidal buckles, which wavelength has been found to be represented as $$\lambda = 2\pi\left(\frac{EI\Delta r}{w}\right)^{\frac{1}{4}}, \tag{1}$$

where, EI denotes the bending stiffness of the tubing string, w denotes the buoyant weight per unit length of the tubing string, and Δr denotes the radial clearance between the tubing string and the cylindrical constraint (i.e., the wellbore).

The buoyant weight per unit length of the tubing string is represented by $$w=(\rho_{tubing}-\rho_{fluid})\times A_{tubing}\times g \tag{2},$$

where $\rho_{tubing}$ denotes the density of the tubing, $\rho_{fluid}$ denotes the density of the fluid in the wellbore around the tubing, $A_{tubing}$ denotes the cross sectional area of the tubing, and g denotes the gravitational constant.

During the experiments it was observed from the sinusoidally-buckled tubing string that the wavelength of vibration of the tubing string was about ¼ to ½ of the wavelength λ of sinusoidal buckles. Therefore, for example, for a special case of a tubing string in a borehole that is modeled as a deflecting beam with ¼ of the wavelength λ of sinusoidal buckles, the natural frequency for bending resonance is represented as $$f = \frac{1}{2\pi}\left(\frac{k}{\lambda/4}\right)^2\sqrt{\frac{EI}{\rho A}}, \tag{3}$$

where ρ denotes an effective density of the tubing string that depends upon the fluid surrounding the tubing string in the wellbore, A denotes the cross-section area of the tubing string, and k denotes a constant that depends upon the boundary conditions assumed for the beam bending resonance of the tubing string and ρA denotes an effective mass per unit length of the vibrating pipe. The effective mass per unit length may be represented according to $$\rho A=(\rho_{-tube}*A+\rho_{fluid}*(Ao+Ai)) \tag{4}.$$

where Ao=(π/4)*Do^2, Ai=(π/4)*Di^2; A=Ao−Ai and with Di and Do being the inner and outer diameter of the tube. Note that the term "ρ_fluid*Ai" represents the fluid inside the tube, which will approximately be moving at the same lateral speed of the tube; while the term "ρ_fluid*Ao" represents the low frequency approximation of the virtual outer added mass due to the fact that the tube is pushing the fluid around it as it moves.

By substituting equation (1) into equation (3), the frequency for bending resonance may be expressed according to $$f = \frac{2k^2}{\pi^3}\sqrt{\frac{w}{\Delta r\rho A}} \tag{5}$$

It will be appreciated from the foregoing discussion that, according to one aspect, the optimal vibration frequency is chosen based at least partially on the radial clearance Δr between the tubing string and the borehole. According to another aspect, the optimal vibration frequency is chosen based, at least partially on the value of the constant k that is used in equation (5). In one embodiment the value of k used in equation (5) is selected based on modeling assumptions regarding how the ends of the tubing string are constrained in the wellbore. For example, for clamped boundary conditions, k may be modeled to have the value of 1.5π, while for a tubing string that is modeled as being simply supported, k may be modeled to have the value of π. According to another aspect, the optimal vibration frequency is based, at least partially, on the values of w, ρ, and A. According to another aspect, the optimal vibration frequency is calculated according to equation (5).

Figure 4:
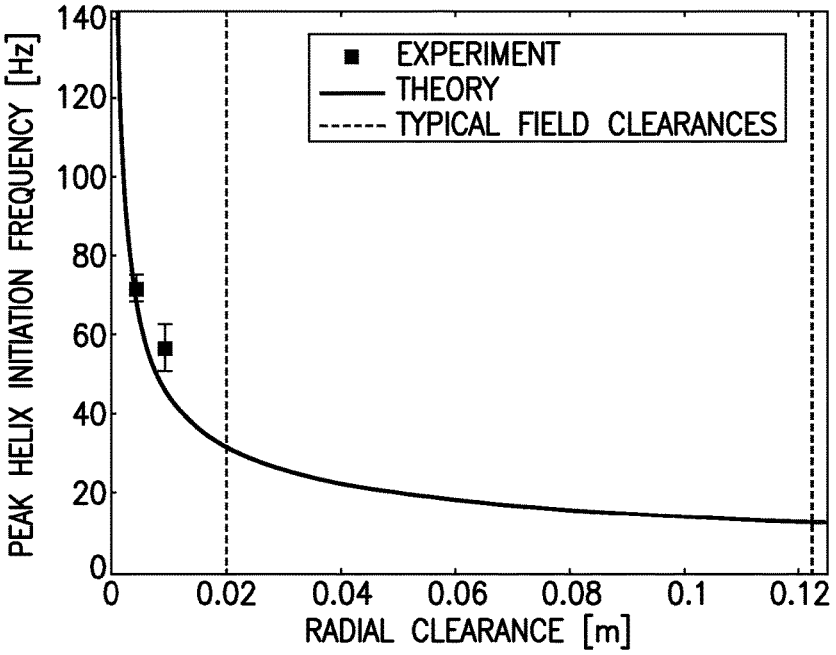
FIG. 4 shows a theoretical plot of peak helix initiation frequency as a function of radial clearance plotted along with experimental data from the plot of FIG. 3.

FIG. 4 shows a plot of vibration frequency calculated using equation (5) as well as experimental vibration frequency data plotted as functions of radial clearance. The experimental data was obtained using the tubing string and cylindrical constraints used in the above-mentioned experiment. For example, the radial clearance for the smaller inner diameter pipe is 4.42 mm, while the radial clearance for the larger diameter pipe is 9.27 mm. The calculated frequency data was generated using equation (5) based on known values of w, ρ, and A. The solid line shows the theoretical curve defined by equation (5), assuming clamped boundary conditions (k=1.5π) and a bending mode of length λ/4. The square dots and confidence intervals correspond to the experimental data for the two experimental configurations of tubing string and cylindrical constraint. The theoretical frequency values calculated in accordance with equation (5) show acceptable agreement with the experimental data, thereby validating the foregoing approach based on the assumed boundary conditions. Also, the solid curve shows that as the radial clearance between the tubing string and the pipe (i.e., the wellbore) increases, the optimal vibration frequency decreases. FIG. 4 also shows that for typical radial clearance between wellbores and tubing strings, which is about 2 cm, the optimum frequency calculated is about 30 Hz given the experimental conditions and assuming that $k=1.5\pi$.

Once the frequency is determined using equation (5), the tubing string can be vibrated at that determined frequency as the tubing string is being introduced into the wellbore. The vibration is employed in order to delay/avoid the onset of helical buckling of the coiled tubing string and/or to allow progress into the wellbore in the presence of helically buckled tubing. Because the frequency determined using equation (5) depends in large part on a modeled parameter k, it will be appreciated that the determined frequency may not necessarily lead to a maximum reach extension when the tubing string is vibrated at that frequency. For example, the modeled boundary conditions may be based on incorrect or incomplete assumptions about the tubing string and the well geometry. Therefore, in practice it may be necessary to tune the value of k to account for such assumptions and recalculate equation (5) using different values of k to determine corresponding frequency values that will result in maximum reach extension of the tubing string. Thus, the frequency determined using equation (5) may correspond to maximum reach extension of a tubing string, or at worst, may correspond to a reach extension close to the maximum reach extension.

Figure 5:
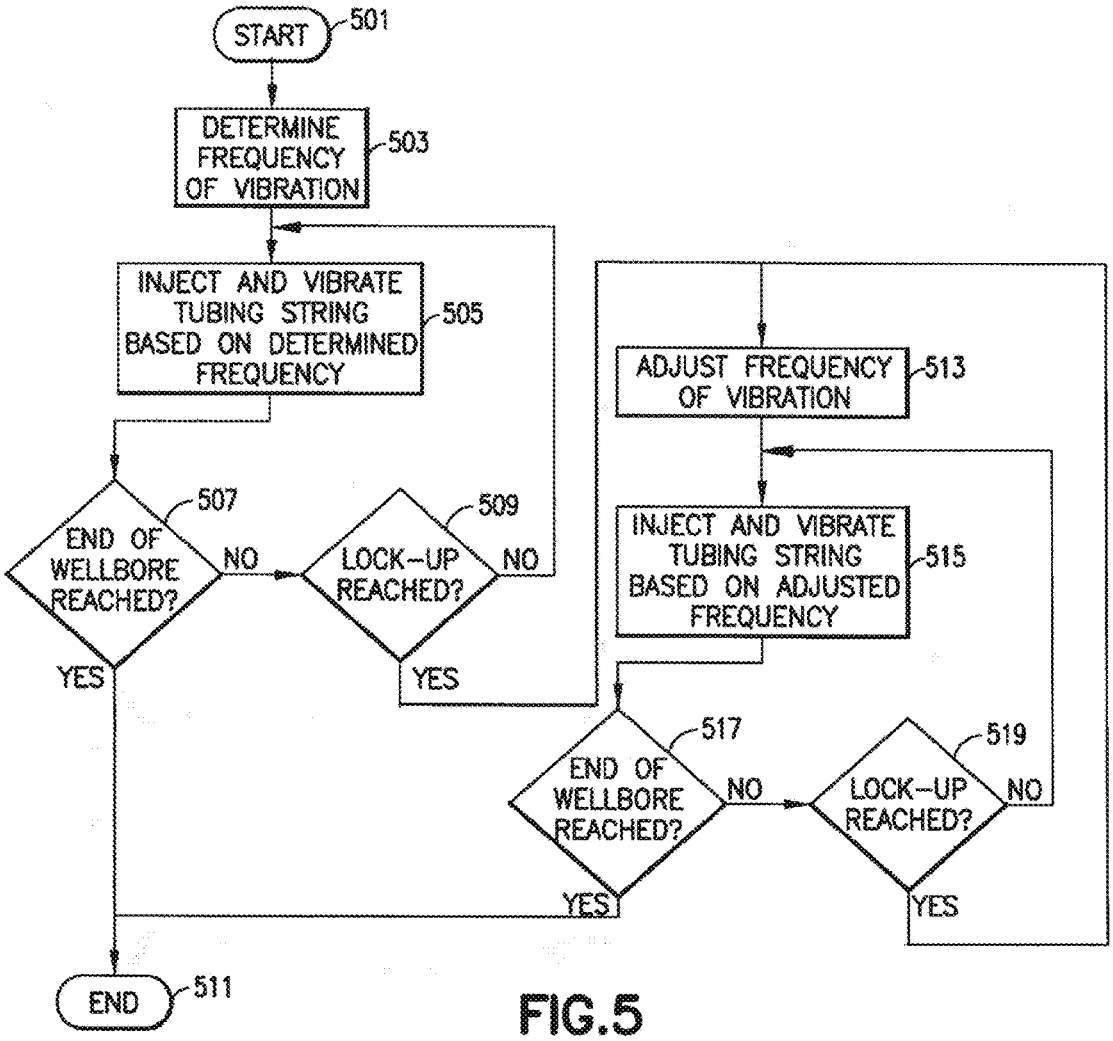
FIG. 5 illustrates an embodiment of a workflow for extending reach of a coiled tubing string in a deviated wellbore.

FIG. 5 shows an example of a workflow in accordance with an aspect of the disclosure. At 501 the workflow is initialized and physical properties of the wellbore and the tubing string are obtained for use in equation (5). At 503 the frequency of vibration of the tubing string is determined based on equation (5) using a selected value of the constant k. At 505 the tubing string is vibrated at the frequency determined at 503 and injected into the wellbore. At 507 it is determined whether the end of the wellbore has been reached. If the end of the wellbore has been reached (YES at 507), then the workflow ends at 511. If the end of the wellbore has not been reached (NO at 507), then it is determined whether lock-up has occurred at 509. If lock-up has not occurred (NO at 509), then the tubing string continues to be vibrated at the frequency determined at 503 as the tubing string is injected farther into the wellbore at 505. If lock-up is about to or has occurred (YES at 509), then the frequency determined at 503 is adjusted at 513 and the tubing string is injected while the tubing string is vibrated at the adjusted frequency at 515. At 517 it is determined whether the end of the well bore has been reached. If the end of the wellbore has been reached (YES at 517), then the workflow ends at 511. If the end of the wellbore has not been reached (NO at 517), then it is determined whether lockup has occurred at 519. If lock-up has not occurred (NO at 519), then the tubing string continues to be injected into the borehole while being vibrated at the adjusted frequency determined at 513. If lock-up has occurred (YES at 519), then the frequency is adjusted again at 513 and the tubing string is injected and vibrated at the re-adjusted frequency. The workflow ends at 511 when the end of the wellbore is reached or when adjusting the frequency does not obtain additional reach as indicated by the dashed lines from 509 to 511 and from 519 to 511, respectively.

In one embodiment, the adjusted frequency may be determined by recalculating equation (5) using a value of k that is different from the value of k used to determine the frequency determined at 503.

Figure 6:
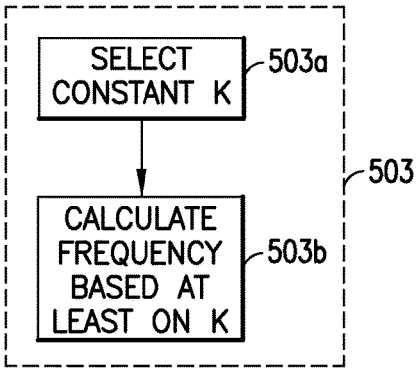
FIG. 6 illustrates a further detail of a process of the workflow shown in FIG. 5.

FIG. 6 shows further details of the frequency determination of 503 shown in FIG. 5. At 503*a*, a value of k is selected based on modeled boundary conditions for the tubing string in the wellbore. As noted above, in one embodiment, the value of k that is selected is between n and 1.5n. At process 503*b*, the frequency of vibration is calculated using equation (5) based on the selected value of k and the other parameters from equation (5) that are specific to the wellbore and the tubing string.

In one aspect, some of the methods and processes described above, such as the workflow described with respect to FIGS. 5 and 6 are performed by a processor. The term "processor" should not be construed to limit the embodiments disclosed herein to any particular device type or system. The processor may include a computer system. The computer system may also include a computer processor (e.g., a microprocessor, microcontroller, digital signal processor, or general purpose computer) for executing any of the methods and processes described above. The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Figure 7:
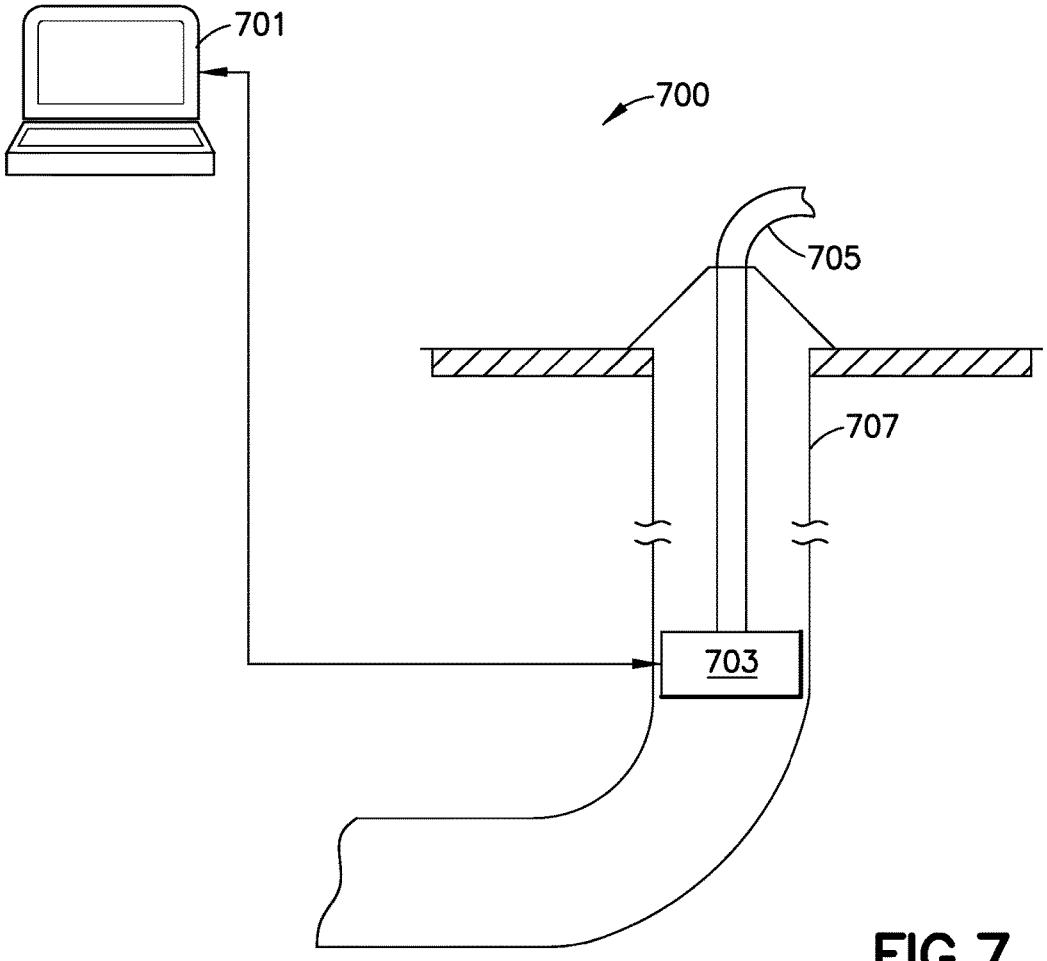
FIG. 7 illustrates an embodiment of a system for extending reach of a coiled tubing string in a deviated wellbore.

FIG. 7 shows an example of a system 700 for extending reach of a coiled tubing string in a deviated wellbore. The system 700 includes a processor 701, which may include, in one embodiment, a computer system described above. In one embodiment, the computer system includes a computer processor (e.g., a microprocessor, microcontroller, digital signal processor, or general purpose computer) for executing the workflow described herein, such as the workflow shown in FIGS. 5 and 6. The processor 701 is communicatively coupled to a vibration source 703. The processor 701 may communicate via a wired or wireless connection with the vibration source 703. The processor 701 determines a vibration frequency for vibrating a tubing string 705 in a wellbore 707 and outputs a vibration frequency control signal based on the determined vibration frequency.

The vibration source 703 is constructed to vibrate the tubing string 705 at the determined frequency based at least on the control signal output from the controller 701. The vibration source 703 may be capable of inducing one or more different types of vibration. Also, the different types of induced vibration can be employed separately or in combination with each other. The types of vibration include axial vibration where vibration is induced along the axis of the coiled tubing/wellbore, lateral vibration where vibration is induced orthogonal to the axis of the coiled tubing/wellbore, torsional-rotational vibration where vibration is induced about the axis of the coiled tubing/wellbore, and lateral rotational-rotational vibration where vibration is induced about an axis orthogonal to the axis of the coiled tubing/wellbore.

Vibration of a tubing string can be induced by one or more vibration sources 703 (e.g., apparatuses) that may be located in one or several locations along the length of the tubing string 705. For example, one location for the vibration source 703 may be at the surface (e.g., at the injector head). Also, for example, the vibration source 703 may be located at or near the free end of the tubing string 705 (e.g., at an element of the bottom hole assembly, such as a tractor, etc.). Additionally, for example, one or more vibration sources 703 may be distributed along the length of the tubing string 705 between its free end in the wellbore 707 and its constrained end at the injector at the surface. The latter example may be accomplished by assembling one or more vibration sources 703 to the coiled tubing 705 during its manufacture or assembling one or more vibration sources 703 onto discrete lengths of the coiled tubing 705 such as at joints of such sections (i.e., connectors joining the discrete lengths may house the vibration sources).

Although only a few examples have been described in detail above, those skilled in the art will readily appreciate that many modifications are possible in the examples without materially departing from this subject disclosure. For example, while the testing discussed herein was conducted employing induced lateral vibration, it will be appreciated that other types of vibration may be employed in conjunction with lateral vibration or in place of lateral vibration. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method for extending reach of a coiled tubing string in a deviated wellbore, the method comprising:

determining a frequency of vibration of the tubing string based on a function of the bending resonance of the tubing string, while the tubing string is buckled; and vibrating the tubing string at the determined frequency while the tubing string is inside the wellbore;

wherein the function of the bending resonance of the tubing string is determined according to the formula:

$$f = \frac{2k^2}{\pi^3}\sqrt{\frac{w}{\Delta r \rho A}}$$

where w is the buoyant weight per unit length of the coiled tubing string, Δr is the radial clearance between the coiled tubing string and the deviated wellbore, k is a constant that depends upon the boundary conditions assumed for the beam bending resonance of the coiled tubing string, and ρA is the effective mass per unit length of a vibrating pipe.

2. The method according to claim 1, wherein:

the bending resonance of the tubing string is determined at least partially by a radial clearance between the tubing string and the wellbore.

3. The method according to claim 1, wherein:

the bending resonance of the tubing string is determined at least partially by a constant relating to boundary conditions of the tubing string.

4. The method according to claim 3, further comprising:

selecting said constant based on said boundary conditions.

5. The method according to claim 3, wherein:

said constant is a value between π and 1.5π.

6. The method according to claim 1, wherein:

said bending resonance of the tubing string is determined at least partially by a radial clearance between the tubing string and the wellbore and by a constant relating to boundary condition of the tubing string.

7. The method according to claim 6, further comprising:

selecting said constant based on said boundary conditions.

8. The method according to claim 6, wherein:

said constant is a value between π and 1.5π.

9. The method according to claim 1, wherein:

said bending resonance of the tubing string is determined at least partially by a buoyant weight per unit length of the tubing string, a cross sectional area of the tubing string, and an effective density of the tubing string.

10. The method according to claim 9, wherein:

said buoyant weight per unit length of the tubing string is based in part on the density of the tubing string, the density of the fluid surrounding the tubing string, and the cross sectional area of the tubing string.

11. The method according to claim 9, wherein:

said effective density of the tubing string is based on a difference between the density of the tubing string and the density of the fluid surrounding the tubing string.

12. The method according to claim 1, wherein:

said vibrating includes inducing at least lateral vibrations orthogonal to an axis of the tubing string.

13. The method according to claim 1, further comprising:

injecting the coiled tubing string into the deviated wellbore.

14. The method according to claim 1, wherein:

the determined frequency is a frequency that excites a bending vibration mode in a sinusoidally buckled portion of the tubing string.

15. The method according to claim 1, wherein:

the tubing string is vibrated by at least one vibration source position along the tubing string in the wellbore.

16. A non-transitory computer-readable storage medium storing an executable computer program for causing a computer to execute a method of extending reach of a coiled tubing string in a deviated wellbore, the method comprising:

determining a frequency of vibration of the tubing string based on a function of the bending resonance of the tubing string, while the tubing string is buckled; and vibrating the tubing string at the determined frequency while the tubing string is inside the wellbore;

wherein the function of the bending resonance of the tubing string is determined according to the formula:

$$f = \frac{2k^2}{\pi^3}\sqrt{\frac{w}{\Delta r \rho A}}$$

where w is the buoyant weight per unit length of the coiled tubing string, Δr is the radial clearance between the coiled tubing string and the deviated wellbore, k is a constant that depends upon the boundary conditions assumed for the beam bending resonance of the coiled tubing string, and ρA is the effective mass per unit length of a vibrating pipe.

17. The non-transitory computer-readable storage medium according to claim 16, wherein:

said bending resonance of the tubing string is determined at least partially by at least one of (a) a radial clearance between the tubing string and the wellbore and (b) a constant relating to boundary conditions of the tubing string.

18. The non-transitory computer-readable storage medium according to claim 17, wherein: said constant is a value between π and 1.5π.

19. A system for extending reach of a coiled tubing string in a deviated wellbore, the system comprising:

a controller constructed to determine a vibration frequency for vibrating the tubing string in the wellbore based on a function of the bending resonance of the tubing and output a vibration frequency control signal based on the determined vibration frequency, while the tubing string is buckled; and a vibration source constructed to vibrate the tubing string at said determined frequency based at least on the control signal output from said controller;

wherein the function of the bending resonance of the tubing string is determined according to the formula:

$$f = \frac{2k^2}{\pi^3}\sqrt{\frac{w}{\Delta r \rho A}}$$

where w is the buoyant weight per unit length of the coiled tubing string, Δr is the radial clearance between the coiled tubing string and the deviated wellbore, k is a constant that depends upon the boundary conditions assumed for the beam bending resonance of the coiled tubing string, and ρA is the effective mass per unit length of a vibrating pipe.

* * * * *